United States Patent [19]

David

[11] Patent Number: 4,837,984

[45] Date of Patent: Jun. 13, 1989

[54] WOOD SURFACE TREATMENT METHOD AND SYSTEM EMPLOYING TANDEMLY ORIENTED CROSS-BELTS AND ROTARY ABRADERS

[75] Inventor: Eugene C. David, New Hope, Minn.

[73] Assignee: Timesavers, Inc., Minneapolis, Minn.

[21] Appl. No.: 71,905

[22] Filed: Jul. 10, 1987

Related U.S. Application Data

[60] Division of Ser. No. 928,790, Nov. 10, 1986, Pat. No. 4,733,500, which is a continuation of Ser. No. 753,869, Jul. 11, 1985, abandoned.

[51] Int. Cl.[4] ..... B24B 1/00

[52] U.S. Cl. ..... 51/326; 51/138

[58] Field of Search ..... 51/281 R, 135 R, 138, 51/137, 3, 326

[56] References Cited

U.S. PATENT DOCUMENTS 3,991,522 11/1976 Hedlund et al. ..... 51/138

4,078,905 3/1978 Oya ..... 51/326

*Primary Examiner*—Frederick R. Schmidt

*Assistant Examiner*—Maurina Rachura

*Attorney, Agent, or Firm*—Orrin M. Haugen; Thomas J. Nikolai; Frederick W. Niebuhr

[57] ABSTRACT

A wood surface treatment system comprising a tandemly arranged endless abrasive cross-belt and flexible rotary abrading surface treating apparatus wherein the abrasive cross-belt portion of the system which includes a platen assembly arranged to move in an oscillatory or epicyclic pattern relative to the work surface and wherein the flexible rotary abrading portion of the apparatus includes a pair of angularly disposed rotary abraders, such as cylindrical brushes. The axis of each individual flexible rotary abrader is disposed at an acute angle, preferably 45 degrees, to the axis of the conveyor, with the individual axes being preferably disposed at 90 degrees, one to the other. The cross-belt portion of the apparatus preferably includes means for drivably oscillating the platen.

5 Claims, 3 Drawing Sheets

WOOD SURFACE TREATMENT METHOD AND SYSTEM EMPLOYING TANDEMLY ORIENTED CROSS-BELTS AND ROTARY ABRADERS

This is a Divisional of application Ser. No. 06/928,790, filed Nov. 10, 1986 now U.S. Pat. No. 4,733,500 which is a Continuation of application Ser. No. 753,869, filed July 11, 1985, now abandoned.

BACKGROUND OF THE INVENTION

The present invention relates generally to a method and apparatus for treating wood surfaces utilizing tandemly arranged endless abrasive belt and flexible rotary abrader and more specifically to a method, apparatus and system utilizing a cross-belt sander arranged in tandem with first and second angularly disposed elongated flexible rotary abraders, with the abrasive cross-belt portion preferably having an oscillating platen. The apparatus forming the system is arranged so that the angularly disposed flexible rotary abraders contact the work surface as a final operation, and following exposure to the abrasive cross-belt. These multiple operations are accomplished in a single pass of the work through the system. As indicated, improved results are achieved when the cross-belt portion has means for orbitally driving its platen at the work-contacting zone or portion of the belt. The improved wood finishing system of the present invention employs either a single or a pair of sequentially arranged abrasive cross-belt sanders, each being provided with an oscillating platen, together with tandemly arranged and angularly disposed first and second flexible rotary abraders, with the axes of the rotary abraders each being arranged at an acute angle relative to the axis of the work conveyor.

The present invention constitutes an improvement over those certain arrangements disclosed and claimed in my co-pending applications Ser. No. 643,701, filed Aug. 24, 1984, and now abandoned in favor of Continuation application Ser. No. 06/874,342, filed June 13, 1986 and now U.S. Pat. No. 4,651,474, issued Mar. 24, 1987 entitled "Wide Belt Sandin Machine with Platen Oscillating Means", and Ser. No. 735,142, filed May 17, 1985, entitled "CROSS-BELT SANDING MACHINE WITH OSCILLATING PLATEN MEANS", both of which are assigned to the same assignee as the present invention, the substance of which are incorporated herein by reference.

Wood finishing systems employing tandemly arranged abrasive belts and flexible rotary abraders have been known in the past. In the present system, however, the flexible rotary abraders are arranged at an acute angle, preferably between about 40 and 45 degrees, to the axis of the conveyor system carrying the work through the system, and generally at approximately right angles of each other. Also, in the system of the present invention, it has been found that improved properties may be obtained in the finished product when the abrasive belts are provided in the form of cross-belts with orbitally driven platens.

Belt sanders utilizing stationary platens are also known in the prior art, with one such system being disclosed in U.S. Pat. No. 3,832,807, Kiser et al., assigned to the same assignee as the present invention. Cross-belt sanders are also well known, including their basic structural framework along with their basic drum or roller mounting means.

In a typical wood finishing system of the present invention utilizing angularly disposed flexible rotary abraders, a cross-belt or wide-belt sander arrangement may be employed together with a pair of flexible rotary abraders arranged in tandem therewith. The flexible rotary abraders are disposed with their axes generally at an acute angle to the axis of the conveyor belt and at approximately right angles to each other.

In a typical cross-belt sanding machine, a platen base is normally provided forming a sanding head and with an endless abrasive belt being trained over a plurality of rollers or drums, at least one of which is power driven, the balance of the rollers being idlers and/or guides for the belt as it moves through its orbit. In the wood finishing system of the present invention, the platen is preferably interposed between a pair of belt guiding rollers, and furthermore the platen is driven along an orbital path. The combination of the orbital platen cross-belt along with the angularly and tandemly arranged first and second flexible rotary abraders provides a highly desirable surface with enhanced smoothness on the work being treated, with the surface being substantially free of grooves or other defects so as to render the material suitably adapted for such fine applications as furniture, cabinetry, and the like.

In the present method and system, the cross-belt portion utilizes a belt or belts which are driven along a generally rectangular orbit or path, with the drive roller or drum preferably being disposed at one upper corner zone of the belt orbit. A sufficient amount of wrap is provided on the drive roller for it to accomplish its drive function, and with added rollers or drums being disposed closely adjacent to and on either side of the platen normally being idlers and adapted to move in an orbital path with the platen per se. The angularly disposed flexible rotary abraders are normally provided with and driven from a separate or independent power source, such as an electrical motor, with the system employing either a direct or a variable speed drive.

In the system the present invention, it has been found that the utilization of the orbital platen together with the tandemly arranged flexible rotary abraders provide for improved performance in a number of ways. For example, the utilization of this arrangement provides for improved and enhanced surface qualities or properties in the work surfaces. Also, with the combination of orbital platens and rotary abraders, it has been found that it is possible to use a coarser grit on the abrasive cross-belts, with greater belt speeds being possible and useful without sacrificing or reducing the surface properties of the finished product. Accordingly, production rates are improved without deterioration of quality of the work product. As indicated above, either a single cross-belt, or two tandemly arranged cross-belt systems may be utilized for the operation, along with a pair of angularly disposed flexible rotary abraders.

A number of different types of flexible rotary abraders are known. Abrasive media brushes and flap abrasive brushes are known and have been used in the past. Abrasive media brushes utilizing nylon bristles impregnated with certain abrasive media are commercially available with a relatively wide variety of bristle diameters. Bristle diameters ranging in size up to over 150 mils are available. While the individual bristles of the abrasive media brushes, including wire bristles, are rigid due to the inherent physical property of the material of construction, flap abrasive brushes derive their rigidity by virtue of centrifugal forces induced by their rotary motion.

Typically, in the present device, work is fed into the machine by a feed system or conveyor assembly that comprises an endless horizontally oriented conveyor belt, the upper span or flight of which may cooperate with one or more pinch-rolls so as to grip the work and feed it through the machine at a uniform rate, and in a predetermined angular direction relative to the belt. The linear motion or travel of the belt determines the transport axis for the work. Alternatively, and in lieu of pinch-rolls, stationary edge guides or fences may be employed. During a typical sanding operation, of course, the top surface of the work is arranged in contact with the working surface of the abrasive cross-belt. In order to accommodate and adapt the apparatus of the present invention to workpieces having different thicknesses, the conveyor assembly is arranged to be adjustable either upwardly or downwardly toward or away from the plane of the cross-belt platen, the assembly normally being supported against the force or thrust of forces created on the work as it is arranged on the conveyor belt. When two cross-belt head assemblies are arranged in tandem, it is normally desirable to provide for horizontal adjustment of at least one of the cross-belt platen surfaces, relative to the other, in order to compensate for stock removal accomplished through exposure to the first cross-belt assembly. Downstream from the cross-belt assemblies, the flexible rotary abraders are situated in superimposed relationship with the belt, with these abraders being mounted with their axes at an acute angle to the transport axis of the conveyor, and with the surface of the rotary abraders coming into light working contact, under modest force, with the surface of the work passing therebelow. In order to accommodate workpieces of various cross-sectional dimension, the flexible rotary abraders are arranged for adjustment relative to the surface of the conveyor belt, and also to adjust the force exerted by the rotary abraders against the work. Belt sanding apparatus with vertically adjustable conveyors are disclosed in U.S. Pat. No. 3,832,807 referred to hereinabove, and reference is made to the disclosure in that patent for the details of the adjustable conveyor design.

SUMMARY OF THE INVENTION

The surface treating method, system, and apparatus of the present invention is intended to perform sanding and finishing operations on a workpiece, with the sanding operation normally being accomplished by the cross-belt driven in contact with the surface of the work while the platen is being driven in an orbital or epicyclic path relative to the work. The abrasive operation is concluded by operatively contacting the surface of the work with angularly disposed elongated flexible rotary abraders, with the abraders normally being in the form of a pair of tandemly arranged abrasive media brushes. The axes of rotation of the elongated flexible rotary abraders, in addition to being at an acute angle of approximately 45 degrees to the axis of the conveyor, are normally at right angles to one another, thereby contributing to the production of a surface of an enhanced quality on the workpieces. The abrasive surface treatment operation, when undertaken with the movable orbiting platen and cross-belt arrangement together with the rotary flexible abraders, provides a highly desirable and uniform finish on wood surfaces, and is particularly suited for wood surfaces designed for cabinetry, furniture or other similar applications.

Briefly, in accordance with the system of the present invention, abrasive cross-belts together with a pair of flexible rotary abraders are arranged to sequentially contact the surface of the work as it moves through the system. With respect to the abrasive cross-belt portion of the system, means are provided for driving the belt platen and a pair of laterally disposed idler rollers along an orbital or epicyclic path while the abrasive cross-belt is being carried across the platen in its normal working path. This orbital motion of the platen together with the subsequent utilization of the flexible rotary abraders provides, in a single operational pass, a high quality finish on the surface of a wide variety of workpieces. In order to provide for substantially continuous operation of the apparatus, including the abrasive belt, compressed air discharge means or other known belt and brush cleaning methods are provided to reduce and/or eliminate the build up of wood particles or dust on the working surface of the abrasive belt and/or brushes or other flexible rotary abraders.

Therefore, it is a primary object of the present invention to provide an improved method, system, apparatus and machine intended to sequentially perform surface treatment operations on wood, including sanding and brushing operations, and wherein the sanding operation is undertaken with cross-belts and wherein the cross-belt and adjacent drive components of the apparatus are driven in an oscillating or orbital path and with this operation being followed by a final operation including exposure of the work to first and second angularly disposed flexible rotary abraders.

It is a further object of the present invention to provide an improved method and system for wood finishing operations employing the combination of a cross-belt sanding apparatus and a flexible rotary abrader, and wherein first and second elongated flexible rotary abraders are provided tandemly of the cross-belt or belts, with the axes of the elongated flexible rotary abraders being disposed at acute angles relative to the conveyor belt axis, and at right angles, one to the other.

Other and further objects of the present invention will become apparent to those skilled in the art upon a study of the following specification, appended claims, and accompanying drawings.

DESCRIPTION OF THE PREFERRED EMBODIMENT

Figure 1:
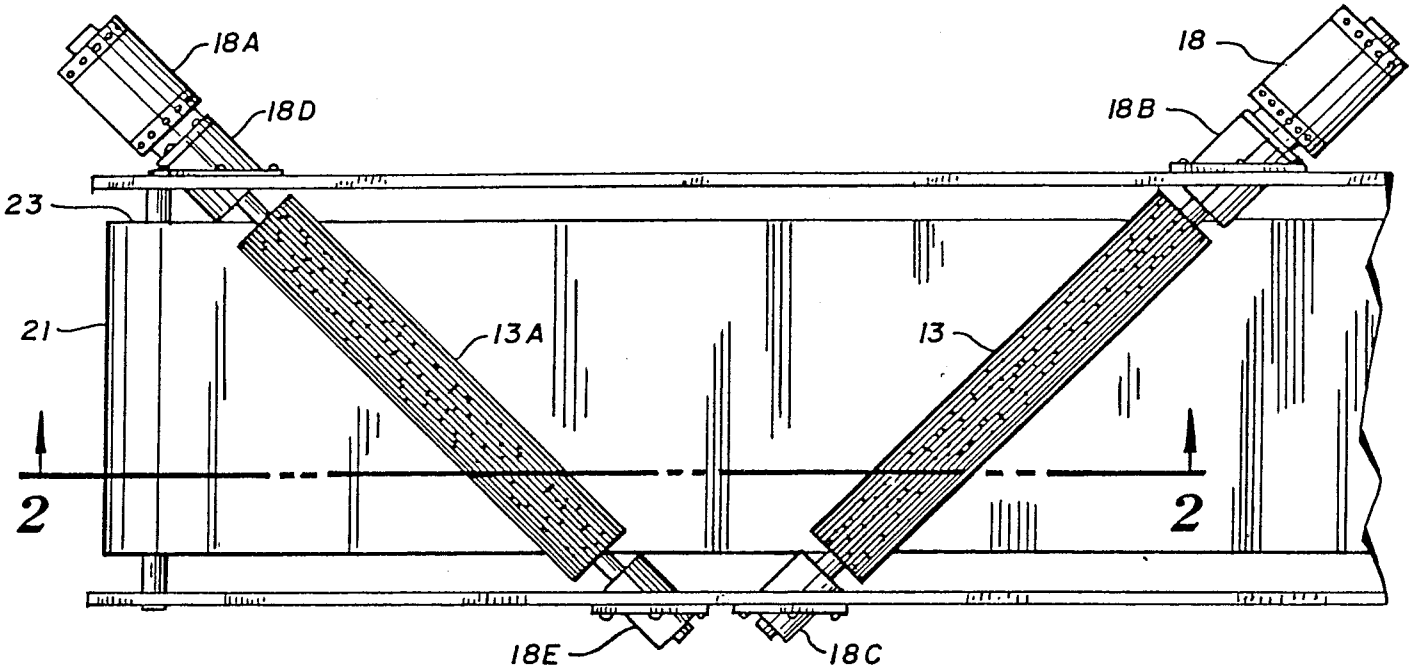
FIG. 1 is an enlarged fragementary top plan view of the outfeed portion of the cross-belt sanding apparatus and work surface treatment system prepared in accordance with the present invention, with FIG. 1 showing the outfeed conveyor and flexible rotary abrader portion of the machine, and with the cross-belt portions of the machine being cut away.
Figure 2:
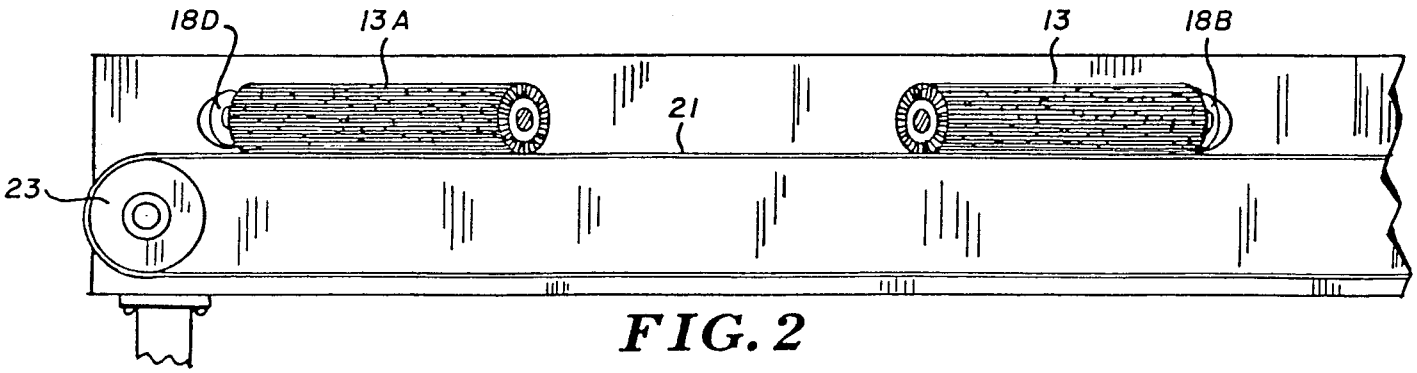
FIG. 2 is a vertical sectional view of the apparatus illustrated in FIG. 1, taken along the line and in the direction of the arrows 2—2 of FIG. 1.
Figure 3:
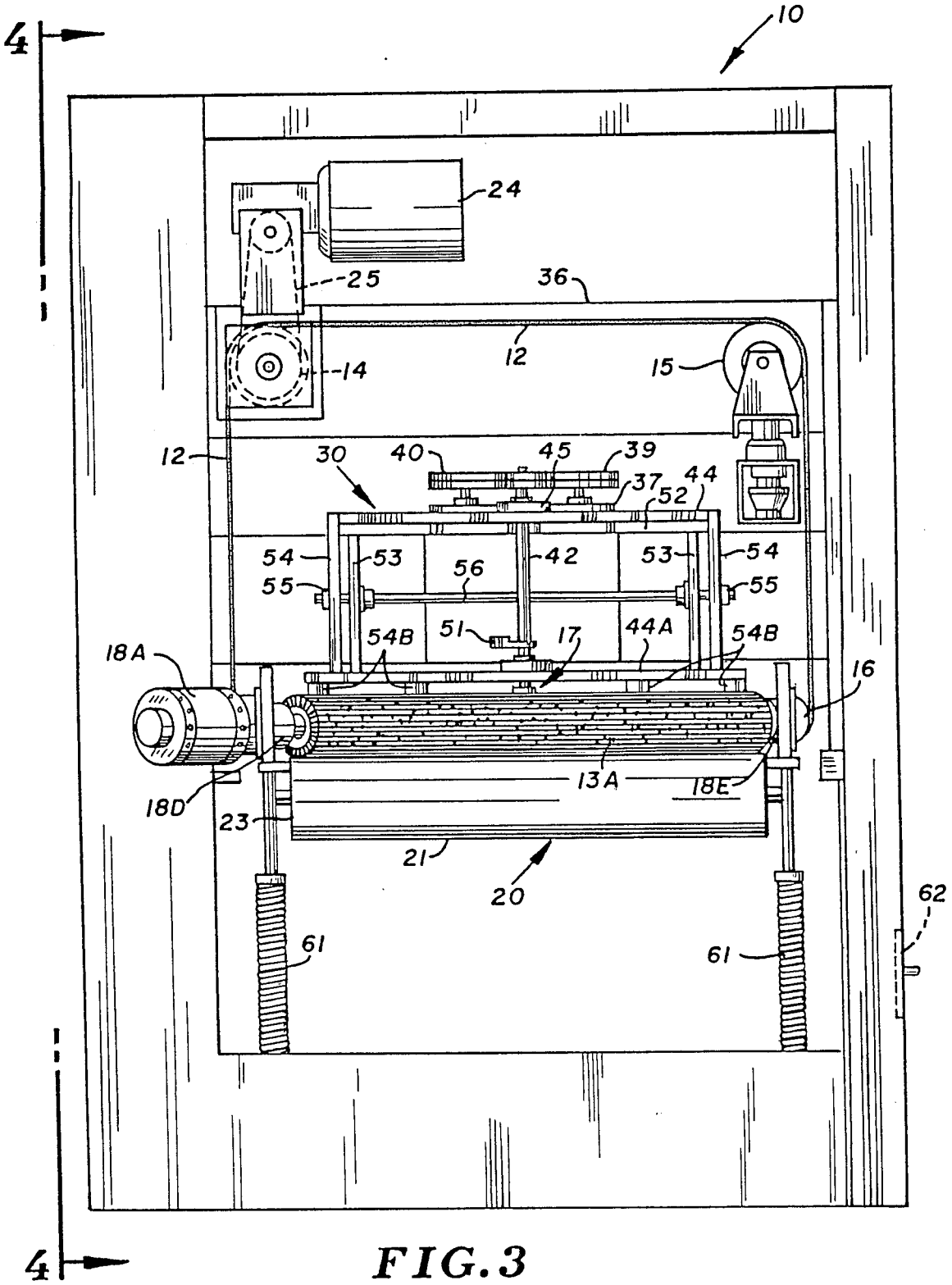
FIG. 3 is an end elevational view of the infeed portion of the system of the present invention.
Figure 4:
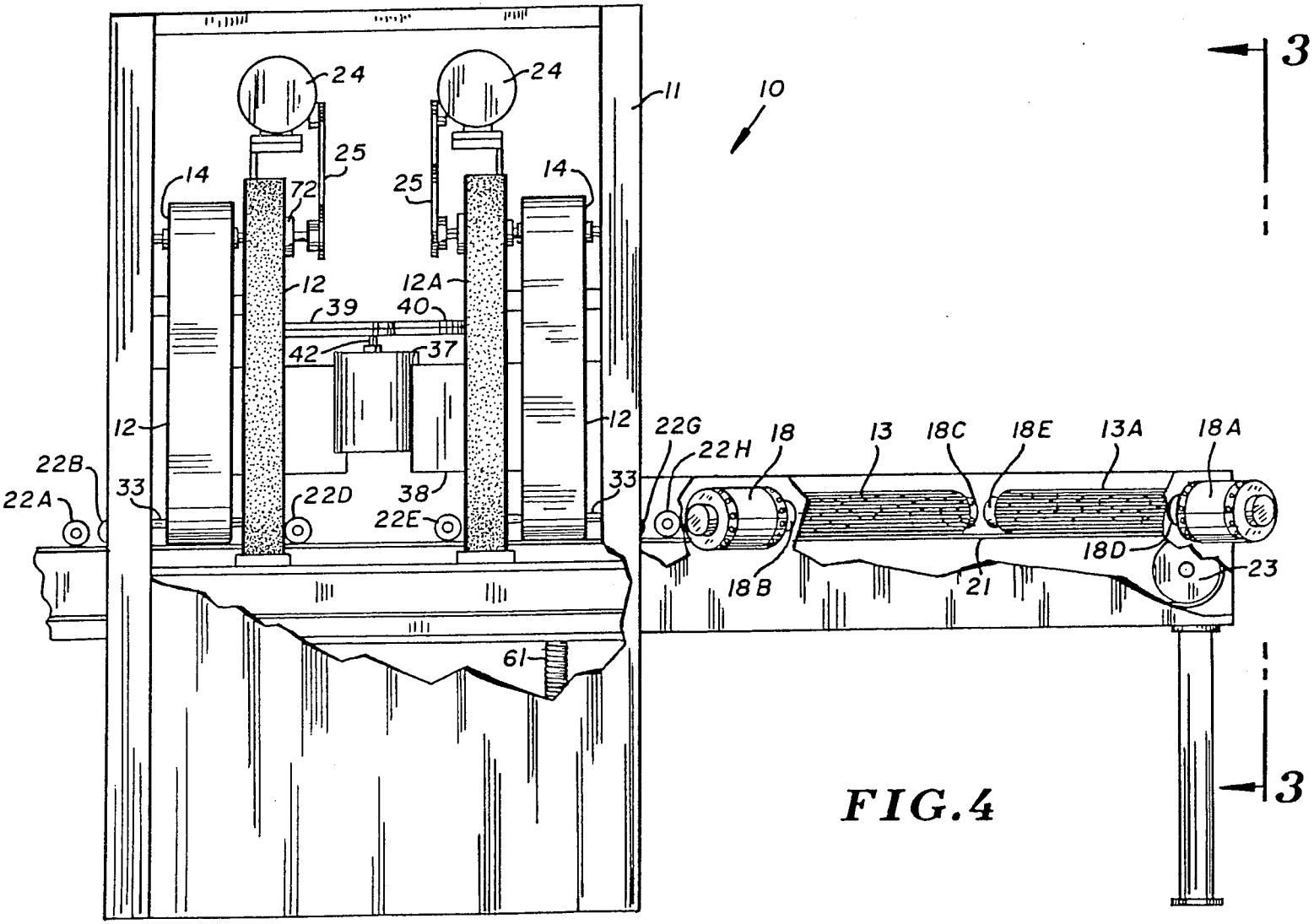
FIG. 4 is a detail side elevational view of a portion of the system showing the arrangement of the cross-belt and flexible rotary abrader treatment stations of the system, with portions of the side plates being broken away.

In accordance with the preferred embodiment of the present invention, and with particular attention being directed to FIGS. 1, 2 and 3 of the drawings, the wood surface treatment system of the present invention generally designated 10 comprises a main frame structure 11, preferably in the form of a rigid structure, such as a weldment, for supporting a work carrying conveyor and or receiving, guiding, and driving first and second endless cross-belts. As illustrated in FIG. 4, cross-belts 12 and 12A are driven about a predetermined orbital path relative to the conveyor and are arranged to abrade the surfaces of workpieces carried along by the conveyor in treating zones defined in the zone between the cross-belts and the conveyor. Downstream from the cross-belts 12 and 12A are a pair of flexible rotary abraders in the form of cylindrical abrasive brushes 13 and 13A, each of which is disposed in superimposed working relationship over the conventional conveyor system. The zones between the flexible rotary abraders and the conveyor form additional treating zones. As indicated, these flexible rotary abraders are each arranged at 45 degrees to the axis of the conveyor, and at substantially 90 degrees, one to another. As is set forth hereinafter, other suitable angular dispositions may be employed.

In the normal working operation, the surface of the flexible rotary abraders, that is the rotary brushes, make contact with the work surface and treat the surface so as to render it smooth and substantially free of channels or other depressions normally created during treatment with wide-belt or cross-belt abrader apparatus, such as the cross-belt utilized in the present system.

In the embodiment illustrated herein, a pair of tandemly arranged cross-belts 12 and 12A are illustrated, with each cross-belt system being similar, one to the other, but with the individual belts being driven in counter-directions. It will be understood that other arrangements may be satisfactorily employed, such as, for example, an abrasive cross-belt system employing a single cross-belt which is useful for a wide variety of operations. In view of the identity of the cross-belt systems, one to the other, and for purposes of simplicity, only one such system need be described in detail. The cross-belt 12 is a typical endless abrasive belt having an outer abrasive coated working surface. Such belts are, of course, in common use and are commercially available. The belt 12 is trained about four individual properly journaled drums or rollers, such as the main drive roller 14, and the upper idler tension adjusting roller 15 and the lower oscillating idlers 16 and 16A. As is apparent from FIGS. 3 and 4 of the drawings, idler drums or rollers 16 and 16A are disposed on opposite lateral edges, such as the leading lateral edge and trailing lateral edge respectively of a platen assembly generally designated 17. In the cross-belt arrangement of the present invention, it has been found to be specifically desirable that the orbiting belt move or travel in an orbit which has a generally rectangular configuration particularly along those areas adjacent the platen assembly. In other words, at least those portions of belt path or travel lying immediately ahead of the leading contact line and those portions lying immediately behind the trailing contact line which the belt makes with idlers 16 and 16A respectively are preferably disposed normal to the plane of the platen assembly. Thus, the axes of guide rollers 14 and 16A are disposed in general vertical alignment, one to another, as are the axes of drums 15 and 16, with the platen assembly being arranged along a generally horizontal plane.

The present arrangement employs the cross-belt sanding machine with oscillating platen means as disclosed and claimed in my co-pending application Ser. No. 735,142, filed May 17, 1985, and reference is made to that disclosure for details of the cross-belt portion of the present system.

A conveyor means is provided to carry work through the apparatus and into contact with the abrasive cross-belt. As illustrated in the drawings, the conveyor means, generally designated 20, includes a belt 21 having an upper span or flight upon which the work is carried, with the path of the belt being controlled by conveyor rolls 22 and 23, one of which is driven so as to carry the belt on its working path. As shown in FIG. 1, and partially in FIG. 3, multiple pinch rolls, such as illustrated at 22A, B, C, D, E, F, G, and H, are optionally arranged to cooperate with the upper flight of belt 21 to both control the forward motion of the work, as well as to function as a hold-down for the workpiece as it moves through the zone between the abrasive cross-belt 12 and conveyor belt 21. The hold-down pinch rolls further operate to maintain the workpiece in proper disposition as it moves into the zone between the flexible rotary abraders 13 and 13A and the conveyor belt 21. In this fashion, therefore, platen 17 along with platen pad 18 is arranged to provide a working force against the inner surface of the endless abrasive belt while the belt is trained about and moving over cross-belt path-defining drums 14, 15, 16, and 16A, and while work is moving along the conveyor 20 in contact with the surfaces of the cross-belts and the flexible rotary abraders.

In the endless abrasive cross-belt work surface treating portion of the system, and particularly in the belt driving portion thereof, cylindrical drum 14 is powered by primary motor 24 and drive chain 25 so as to move the abrasive belt 12 about the individual drums or rollers while it is trained about each of the four orbit defining drums. Each of the individual flexible rotary abraders 13 and 13A is driven by its own drive motor, such as drive motors 18 and 18A respectively. Also, as indicated in FIG. 1, the motors 18 and 18A are mounted onto the side frames by suitable brackets, with the rotary brush shafts being journaled in suitable support bearings as at 18B, 18C, 18D and 18E. In order to accommodate workpieces of different cross-sectional thicknesses, the rotary brush shafts may be adjusted vertically through adjustable positioning of the support bearings 18B through 18E inclusive.

While workpieces are positioned within one working station or treating zone of the cross-belts, the upper surface of the workpiece is arranged to be in contact with and opposed to the abrasive coated outer surface of cross-belt 12. In this fashion, therefore, the surface of the workpiece is abrasively treated, and abraded and/or sanded to its desired surface finish with a surface of high quality normally being prepared. Depending upon the requirements of the operation, the nature of the workpieces, and the grit selection, the apparatus may be designed for coarse treatment of the work, including stock removal, or, alternatively, for such fine operations as sealer-coat sanding. The quality of the surface of the workpiece is enhanced further through exposure to the angularly disposed flexible rotary abraders 13 and 13A, with this additional exposure providing improved uniform properties and characteristics, thereby providing a surface which is immediately ready for application of finishes.

The main frame 11 provides a conventional support to which the belt, the cylindrical drums carrying the belt, and the orbiting platen and the flexible rotary abraders are secured in their operative configuration. Specifically, the platen assembly 17 including lateral guide rollers or drums 16 and 16A are arranged to move in an orbital path in a horizontal plane, or in other words, in a plane which is parallel to the surface of the work being treated. The mechanism for providing orbital motion to the platen assembly is illustrated in detail in FIG. 3 of the drawings, and still further details of a somewhat modified embodiment are shown in co-pending application Ser. No. 874,342. The main frame 11, accordingly provides for a continuous flow of work to be treated initially by the cross-belts, and thereafter by the flexible rotary abraders.

With attention being specifically directed to FIG. 3, the platen assembly 17 includes lateral side support rails 31 and 32 having journals therein as at 33—33 for example for rotatably supporting rollers 16 and 16A therewithin. The guide rollers or drums 16 and 16A are mounted so as to be journaled for axial parallel rotation, and are, as indicated, positioned at oppositely disposed laterally leading and trailing edges of the platen assembly 17. Furthermore and as hereinafter more fully described, orbital motion generating means are coupled to a drive system for providing the orbital motion to the platen 17 as well as to the rollers 16 and 16A.

With continued attention being directed to FIG. 3, a rigid tubular upper cross-beam assembly 36 is provided, being secured to side frame members of main frame 11. Upper cross-beam 36 along with tubular lower cross-beam 36A provide means to receive a cantilevered support for portions of the abrasive cross-belt driving system, including the main drive and the drive system for providing the orbital motion to the platen. The orbital motion generating means includes drive motor 37, which is coupled through an adjustable bracket 38 to lower cross-member assembly 36A. One motor 37 drives endless belt 39, preferably a V-belt, through its motor shaft pulley, while a second belt 40 further is driven by the second motor 37, and with both belts 39 and 40 being trained about individual driven pulley members 41. Each pulley 41 is fast on its associated drive shaft 42 and, of course, is rotatable therewith. Chain drives may also be satisfactorily employed.

Shaft 42 constitutes a drive shaft for the eccentric cam 43 which is disposed at the lower end thereof. In this connection, shaft 42 is journaled within upper frame member 44 as at 45. Shaft 42 is further journaled within lower frame member 44A within a lower bearing assembly. Rotational motion of shaft 42 provides for orbital motion of platen 17 by virtue of an eccentric drive cam as more fully described in co-pending application Ser. No. 735,142. As shown in FIG. 3, a number of resilient mounting pads are provided at 54B—54B in order to couple platen assembly 17 to the member 44A. In this connection, therefore, resilient mounting pads 54B—54B are in the form of rubber coupling cylinders, and permit modest controlled relative motion to occur between platen assembly 17 and the frame assembly 30.

Frame assembly 30 includes vertically arranged weldment side members 54—54, each of which are provided with cam-receiving bores as at 55—55. Inwardly of members 44, 44A and 54—54 of frame 30 are horizontal member 52 along with vertically arranged side panels 53—53. Horizontal member 52 may be a segment of tubular cross-beam 36A. Members 53—53 are secured to member 52 in order to complete a stabilized assembly movable relative to assembly 30.

Cross-shaft 56 is provided, with height adjusting cams being disposed at the outer ends thereof, and within cam-following bores 55—55. The tip end, or another zone of shaft 56 is provided with flats for application of torque to the shaft. Thus, rotational motion of shaft 56 is translated into a vertical height adjustment for frame assembly 30, and ultimately platen assembly 17. As previously indicated, vertical adjustment for individual platen assemblies is normally not required, excepting in those situations where more than one cross-belt assembly is disposed in operative relationship with a single conveyor. Also, vertical adjustment of the platen assemblies provides for ease of adjustment of the overall surface treating assembly with respect to the flexible rotary abraders 13 and 13A.

In order to reduce or minimize vibration, shaft 42 is provided with a counter-weight 51 which equalizes the dynamic loading imposed upon the system by the orbiting platen assembly, and counter-balances these forces. This reduces and/or eliminates vibration in the system when the system is operative.

As the work moves through the cross-belt station, wood particles removed from the surface of the work may become embedded in the surface of the abrasive belt. In order to assist in reduction of build up of accumulated dust particles, air jets may be provided, with the nozzle portions thereof being directed onto the surface of the belt either at a point adjacent its contact with the work or another convenient location. In order to reduce the discharge of dust into the ambient, a counter-rotating brush or air-lock paddle drums, which rotate counter to the direction of motion of the belt may be provided for control of the dust-ladened air particularly in the zone adjacent belt 12. Suitable dust removal hoods may be provided, with such dust removal hoods being conventional and in accordance, for example, with those disclosed in U.S. Pat. No. 3,872,627, Schuster, assigned to the same assignee as the present invention.

In order to control the work thickness dimension for accommodating work within working station 27, conveyor 20 is controllably raised and lowered by means of screws, jacks or shafts 61—61, the axial disposition of which are ultimately controlled by crank wheel 62. In other words, rotation of crank wheel 62 in the direction of the double-headed arrow 63 will raise and/or lower the plane of the upper flight of conveyor belt 21. Such an arrangement is, of course, conventional and well-known in the art. Gear boxes are provided for imparting axial motion to individual screw shafts 61—61.

In order to provide the energy needed to move abrasive cross-belt 12, main motor 24 is provided with its output shaft being, in turn, operatively coupled to drive drum 14 through chain 25 so as to impart drive motion to cross-belt 12. As is indicated in FIG. 2, drive roller or drum 14 is journaled in bearing 72, and is, in turn, coupled to upper cross-member 36 through a cantilevered support bracket or member. In order to maintain proper belt-tracking, a conventional tracking guide assembly may be utilized. One such assembly in accordance with the belt tracking assembly disclosed in U.S. Pat. No. 3,504,458, Rutt, may be used. Belt tracking may be accomplished further in accordance with the apparatus disclosed in U.S. Pat. No. 3,971,166, and assigned to the same assignee as the present invention. When the work leaves the cross-belt stations and enters the zone adjacent the flexible rotary abraders 13 and 13A, the work surface is sequentially contacted by the individual first and second elongated rotating brushes. The direction of rotation of the individual rotary abraders 13 and 13A is preferably counter to the direction of motion of the work along the conveyor.

In a typical operation, flexible rotary abraders 13 and 13A are in the form of abrasive media brushes having a rigidity determined by the utilization of nylon bristles having a diameter of between 10 and 150 mils. For general applications, nylon bristles of approximately 20 mils diameter are useful. Such brushes are, of course, commercially available. Also, in a typical application, rotary brushes 13 and 13A are typically approximately 12 inches in diameter. It will be appreciated, of course, that other abrasive brushes and other combinations may be employed, if desired. In addition to abrasive brushes, other flexible rotary abraders may be employed such as felt abraders. Rotary felt abraders may be employed in those applications where a less coarse treatment may be indicated.

For most applications, rotary speeds of approximately 500 to 1800 rpm are indicated for rotary brushes 13 and 13A. Such speeds are adapted for use in combination with conveyor speeds of between about 5 feet per minute and 40 feet per minute. It will be appreciated, of course, that other drive rates may be successfully employed, with the rates set forth above being deemed most applicable for use with surface treatment of hardwoods such as oak.

In certain operations, treatment of the work may be undertaken with the angularly disposed flexible rotary abraders constituting the primary operation for enhancing the smoothness of the wood surfaces being treated. However, and as indicated hereinabove, the present system provides a means for accomplishing multiple finishing operations on wood surfaces in a single pass device.

What is claimed is:

1. A method of treating a wood surface of a wooden workpiece for enhancing the smoothness of the wood surface which comprises the steps of:

placing the wooden workpiece to be treated on a continuously moving base support for continuous linear movement in a transport direction through first, second and third sequentially arranged treating zones;

exposing the wood surface of said wooden workpiece while in said first treating zone to the action of an endless first abrasive belt moving about belt axes substantially parallel to said transport direction and along a path including a linear path segment with the path segment of the belt moving generally transversely to said transport direction; and exposing the wood surface of said wooden workpiece to the action of first and second angularly disposed flexible rotary abraders while moving said workpiece through said second and third treatment zones respectively, said flexible rotary abraders each being rotated about respective first and second angularly disposed axes and wherein said first and second axes are each disposed at a certain acute angle relative to said workpiece transport direction;

said first flexible rotary abrader contacting the wood surface in said second treating zone along a surface treating axis disposed generally at right angles to the surface treating axis of said second flexible rotary abrader in said third treating zone.

2. The method as defined in claim 1 being particularly characterized in that said certain acute angle is substantially 45 degrees.

3. The method as defined in claim 1 further characterized in that:

the wood surface of the wooden workpiece is at least generally planar, and the step of placing the wooden workpiece on a continuously moving base support includes positioning said wood surface in a predetermined plane parallel to said transport direction, with said linear path of said abrasive belt and said treating axes of said first and second flexible rotary abraders being substantially in said predetermined plane.

4. The method as defined in claim 1 further characterized to include the step of:

exposing the wood surface of said wooden workpiece while in said first treating zone to the action of a second abrasive belt moving along an abrading path generally transverse to said transport direction and opposite to the direction of said linear path segment of said first abrasive belt.

5. The method as defined in claim 1 further characterized in that:

the step of exposing the wood surface of said wooden workpiece in said first treating zone includes the step of moving a means defining said linear path segment of said abrasive belt in an orbital path about an axis normal to said transport direction and normal to said linear path segment.

* * * * *